US010871344B2

(12) United States Patent
Brown, Jr.

(10) Patent No.: US 10,871,344 B2
(45) Date of Patent: Dec. 22, 2020

(54) FIREARM WITH SELF-DEPLOYING STOCK

(71) Applicant: AMBIMJB, LLC, Baltimore, MD (US)

(72) Inventor: Michael Jay Brown, Jr., Baltimore, MD (US)

(73) Assignee: AMBIMJB, LLC, Baltimore, MD (US)

( * ) Notice: Subject to any disclaimer, the term of this patent is extended or adjusted under 35 U.S.C. 154(b) by 0 days.

(21) Appl. No.: 16/226,110

(22) Filed: Dec. 19, 2018

(65) Prior Publication Data

US 2020/0200505 A1 Jun. 25, 2020

(51) Int. Cl.

| | |
|---|---|
| ***F41C 23/04*** | (2006.01) |
| ***F41C 23/20*** | (2006.01) |
| ***F41G 11/00*** | (2006.01) |
| ***F41C 23/14*** | (2006.01) |

(52) U.S. Cl.

CPC ..... *F41C 23/04* (2013.01); *F41C 23/14* (2013.01); *F41C 23/20* (2013.01); *F41G 11/003* (2013.01)

(58) Field of Classification Search

CPC ..... F41C 23/04; F41C 23/14; F41C 23/20; F41G 11/003

See application file for complete search history.

(56) References Cited

U.S. PATENT DOCUMENTS

| | | | | |
|---|---|---|---|---|
| 225,062 | A * | 3/1880 | Kinney | F41C 23/12 42/72 |
| 4,383,384 | A | 5/1983 | Fox | |
| 4,430,822 | A * | 2/1984 | Fromming | F41A 3/66 42/71.01 |
| 5,448,940 | A * | 9/1995 | Schuetz | F41A 3/26 89/128 |
| 7,661,348 | B2 * | 2/2010 | Murello | F41A 11/02 89/6 |
| 8,215,047 | B2 * | 7/2012 | Ash, Jr. | F41C 23/16 42/71.01 |
| 8,819,975 | B2 * | 9/2014 | Herring | F41A 3/66 42/6 |
| 8,943,947 | B2 | 2/2015 | Gomez | |
| 9,097,490 | B2 * | 8/2015 | Tseng | F41C 23/12 |
| 9,121,663 | B2 | 9/2015 | Troy et al. | |
| 9,347,739 | B2 * | 5/2016 | Gomirato | F41C 23/04 |
| 9,541,347 | B2 | 1/2017 | Maugham | |
| 9,829,272 | B2 | 11/2017 | Brown | |
| 10,054,394 | B2 | 8/2018 | Jen et al. | |
| 10,088,268 | B2 | 10/2018 | Hewes et al. | |
| 10,107,596 | B2 * | 10/2018 | Greenwood | F41G 11/003 |
| 10,317,156 | B2 * | 6/2019 | Shaver | F41A 11/02 |
| 10,330,432 | B2 * | 6/2019 | Silverman | F41C 23/14 |
| 10,345,074 | B1 * | 7/2019 | Zamlinskiy | F41A 3/66 |

(Continued)

OTHER PUBLICATIONS

"EMA Tactical RONI G1 Glock Carbine Kit", Aug. 9, 2010, https://www.youtube.com/watch?v=mGn_0dZ15x4&t=60s (Year: 2010).*

(Continued)

*Primary Examiner* — Joshua T Semick

(74) *Attorney, Agent, or Firm* — Wood Herron & Evans LLP

(57) ABSTRACT

Provided is a collapsible stock for mounting to the top surface of a firearm. It includes a sliding beam slidably attachable to the top surface and slidable between collapsed and deployed positions. A butt member is on the sliding beam and a latch is configured to releasably hold the sliding beam in at least the collapsed and deployed positions.

10 Claims, 8 Drawing Sheets

(56) References Cited

U.S. PATENT DOCUMENTS

| | | | | |
|---|---|---|---|---|
| 10,578,396 | B2 * | 3/2020 | Teetzel | F41G 11/003 |
| 2012/0131829 | A1 * | 5/2012 | Fistikchi | F41A 3/72<br>42/1.06 |
| 2017/0023328 | A1 | 1/2017 | Irvin et al. | |

OTHER PUBLICATIONS

"Eine Schulter zum Anlehnen!", Apr. 2010, caliber, http://www.specops.at/index_htm_files/Roni%20Artikel.pdf (Year: 2010).*
"SRU Glock PDW kit", Jun. 16, 2018, https://www.youtube.com/watch?v=09AtCQByek8 (Year: 2018).*

* cited by examiner

FIREARM WITH SELF-DEPLOYING STOCK

TECHNICAL FIELD

This invention relates to a collapsible stock for a firearm, particularly a rifle. More specifically, it relates to a stock capable of collapsing to minimal length, that may be self-deploying using an internal spring, and that can be attached to a firearm via a top accessory rail.

BACKGROUND

A wide variety of designs have been proposed for collapsible or folding rifle stocks so that the stored length of the weapon can be significantly shorter than when it is in use. In a standard AR-pattern firearm, an extension tube protrudes from the rear of the lower receiver to provide a housing for the buffer and recoil spring, axially aligned with the bolt carrier assembly for cycling the action. This standard extension or buffer tube significantly limits the extent to which the stock length (length of pole) can be reduced by sliding the buttstock thereof. The buttstock creates further challenges and may preclude cycling of the action when folded.

Various designs have been proposed that shorten the length of the recoil assembly to allow more compact collapsible or folding stocks for the AR-pattern weapon system. Each of these, however, require at least some extension to the rear of the lower receiver, limiting the minimum overall length when a stock is collapsed or folded.

More recently, there have been alternate upper receiver assembly designs that enclose the entire recoil system within the upper receiver, while remaining mountable to a standard AR-pattern lower receiver. These eliminate the need for the extension or buffer tube and have allowed alternate stock designs to attach directly to the threaded interface at the rear of a standard AR-pattern lower receiver. One such foldable stock is shown in U.S. Pat. No. 9,829,272 issued Sep. 28, 2017. Other collapsible stock designs, whether used without a receiver extension or with a shortened receiver extension, have been supported on rods or rails that collapse into positions close to and on opposite sides of the upper receiver. Due to variance in the external features and dimensions of AR-pattern upper receivers, collapsible stocks of this type may not be usable or may interfere with other structure and/or controls of the firearm.

SUMMARY OF THE INVENTION

The present invention provides a collapsible stock for a firearm. A sliding beam is slidably attachable to the top surface of the firearm and slidable between collapsed and deployed positions. A butt member is on the sliding beam and a latch is configured to releasably hold the sliding beam in at least the collapsed and deployed positions.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
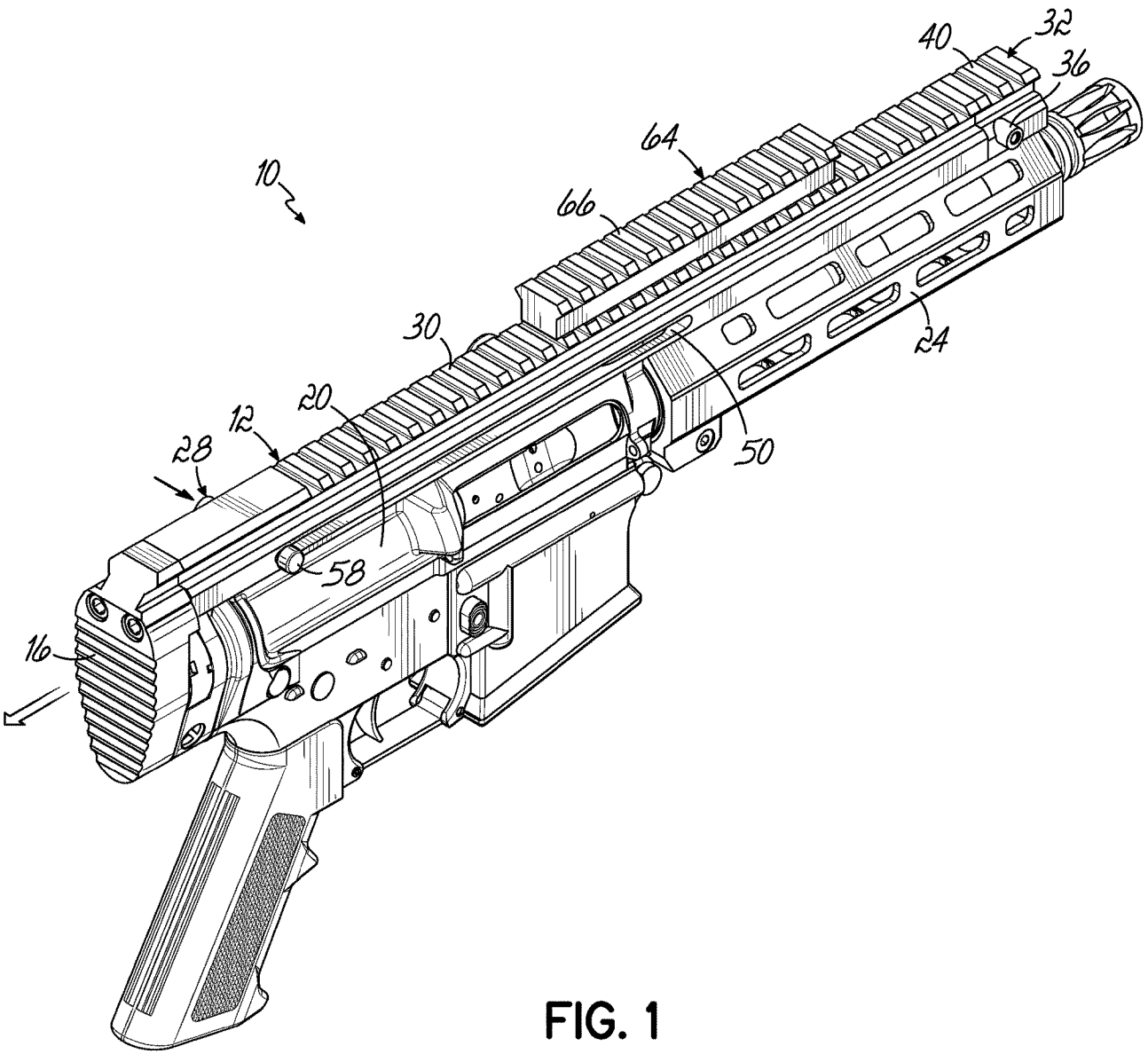
FIG. 1 is an isometric view of a self-deploying stock according to an embodiment of the invention shown in a collapsed position.
Figure 2:
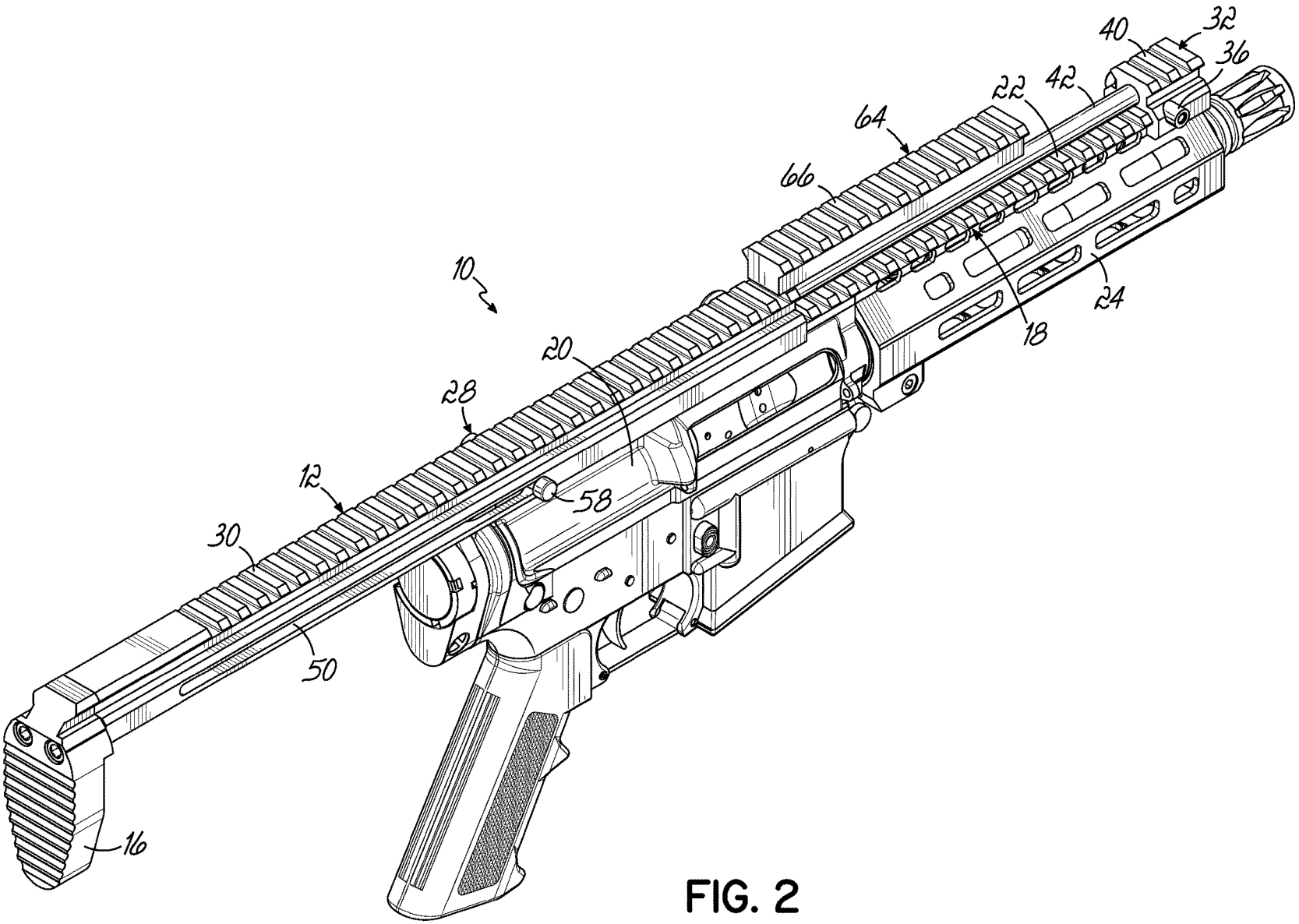
FIG. 2 is a similar isometric view showing the stock in a deployed position.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. "Forward" will indicate the direction of the muzzle and the direction in which projectiles are fired, while "rearward" will indicate the opposite direction. "Lateral" or "transverse" indicates a side-to-side direction generally perpendicular to the axis of the barrel. Although firearms may be used in any orientation, "left" and "right" will generally indicate the sides according to the user's orientation, "top" or "up" will be the upward direction when the firearm is gripped in the ordinary manner.

Referring first to FIGS. 1-4, therein is shown a firearm 10 including a self-deploying stock 12 according to one embodiment of the invention. The stock 12 includes a sliding beam 14 attachable to the top of the firearm 10 with a butt member or plate 16 secured to the beam 14 at the rearmost end. In the illustrated embodiment, the sliding beam 14 is mounted to slide along the top accessory rail 18 of the upper receiver 20 and the top rail 22 of the forearm 24. A 1913 MIL-STD (or Picatinny) accessory rail is almost universally found on AR pattern upper receivers 20 and forearms 24. The upper rails 18, 22 can be continuous (shown), separate, or even separated to some degree. Of course, it can be used with a unitary (monolithic) upper assembly. The dovetail profile of the accessory rail 18, 22 and corresponding channel 26 in the sliding beam 14 allow it to slide smoothly while maintaining a close clearance between the parts. The sliding beam can be locked at one or more pre-selected positions by a transverse latch 28, details of which will be described later.

The sliding beam 14 and butt plate 16 may be milled, cast, or extruded from an aluminum alloy, steel, or a suitable fiber-reinforced polymer material. The top of the sliding beam 14 may also include a 1913 MIL-STD (Picatinny) accessory rail 30 for attachment of sights or other parts or accessories. Despite minor specification differences between the "1913 MIL-STD" and "Picatinny" accessory mounting rails, the terms are used interchangeably herein in reference to standard firearm accessory mounting rails. In place of the butt plate 16, a forearm support brace (not shown) could be used in a pistol configuration and references herein to a "butt plate" are meant to be inclusive of either. For firearms that do not have a top accessory rail (including ones that are not of the AR-pattern), a different slide rail (not shown) that slidingly interfaces with a channel on the sliding beam (not necessarily the Picatinny dovetail profile) can be used to mount the stock 12 to the top surface of a firearm.

According to another aspect or embodiment of the invention, a forward anchor block 32 may be attached to the top rail 22 of the forearm (or top rail 18 of the upper receiver 20) forward of where the sliding beam 14 will rest in its collapsed position. The forward anchor block 32 may include a dovetail channel 38 that mates with the profile of the top rail 18. The forward anchor block 32 may be secured to the rail 22 with a cross bolt 34 and nut 36 that passes between adjacent lugs of the rail 18, for example. It may also include a short length of Picatinny accessory rail 40 matching that of the sliding beam 14 to accommodate mounting of a front sight. The forward anchor block 32 provides a support for a guide tube 42 (shown) or a guide rod (not shown) for a deployment spring 44. The deployment spring 44 and guide tube 42 fit into a longitudinal guide bore or groove 46 of the sliding beam 14.

Figure 3:
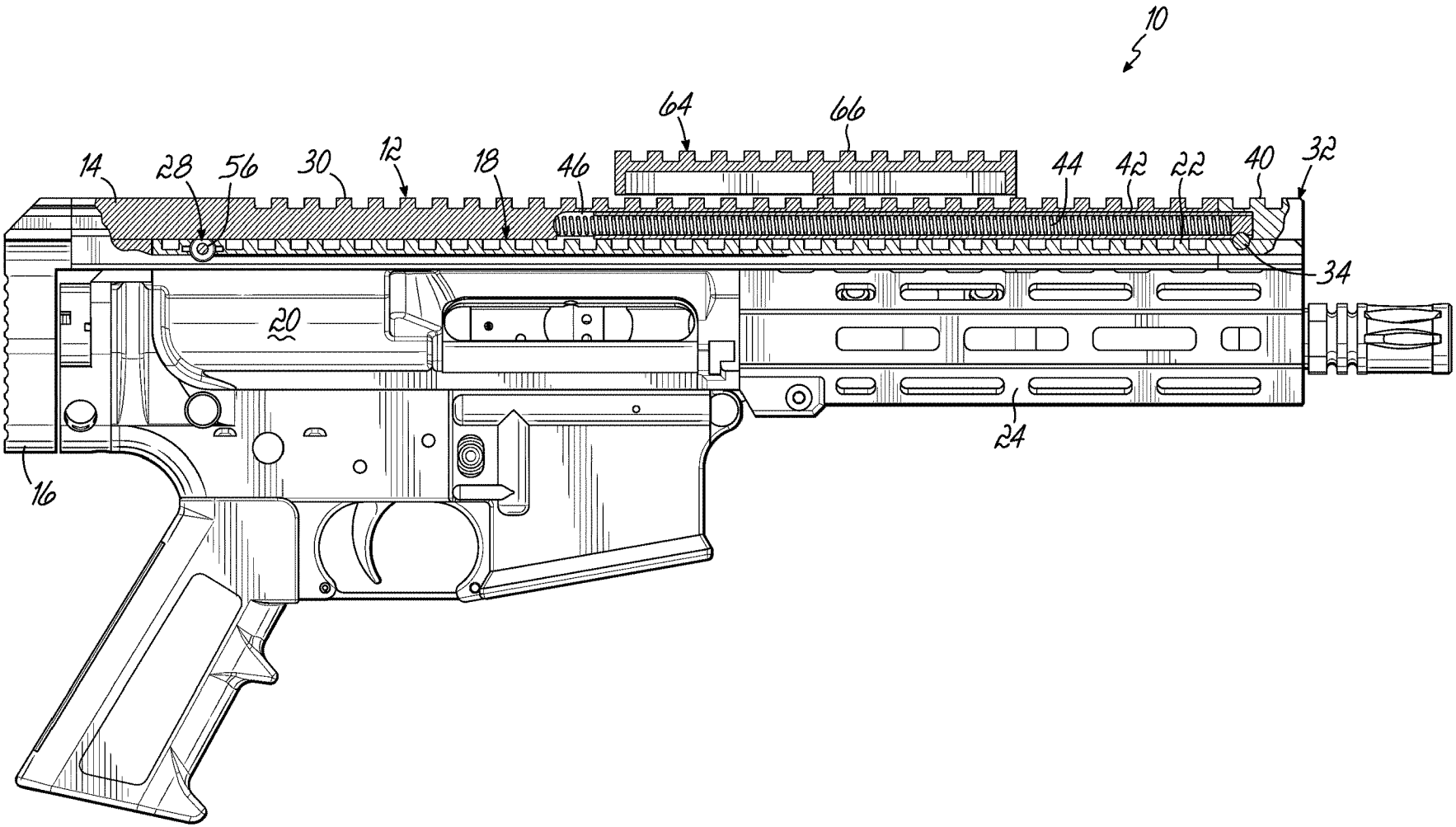
FIG. 3 is a partially cut-away side elevation view showing the stock in a collapsed position.

Referring now in particular to FIG. 3, it can be seen that, when the stock 12 is in the collapsed position, the deployment spring 44 is compressed within the guide tube 42 and guide groove 46. The guide tube 42 telescopes within the guide groove 46. The spring 44 bears against the forward anchor member 32 at the front end, which is secured to the top accessory rail 22 of the forearm 24, and against the sliding beam 14 in a rearward direction, which is locked from movement by the latch 28.

Figure 4:
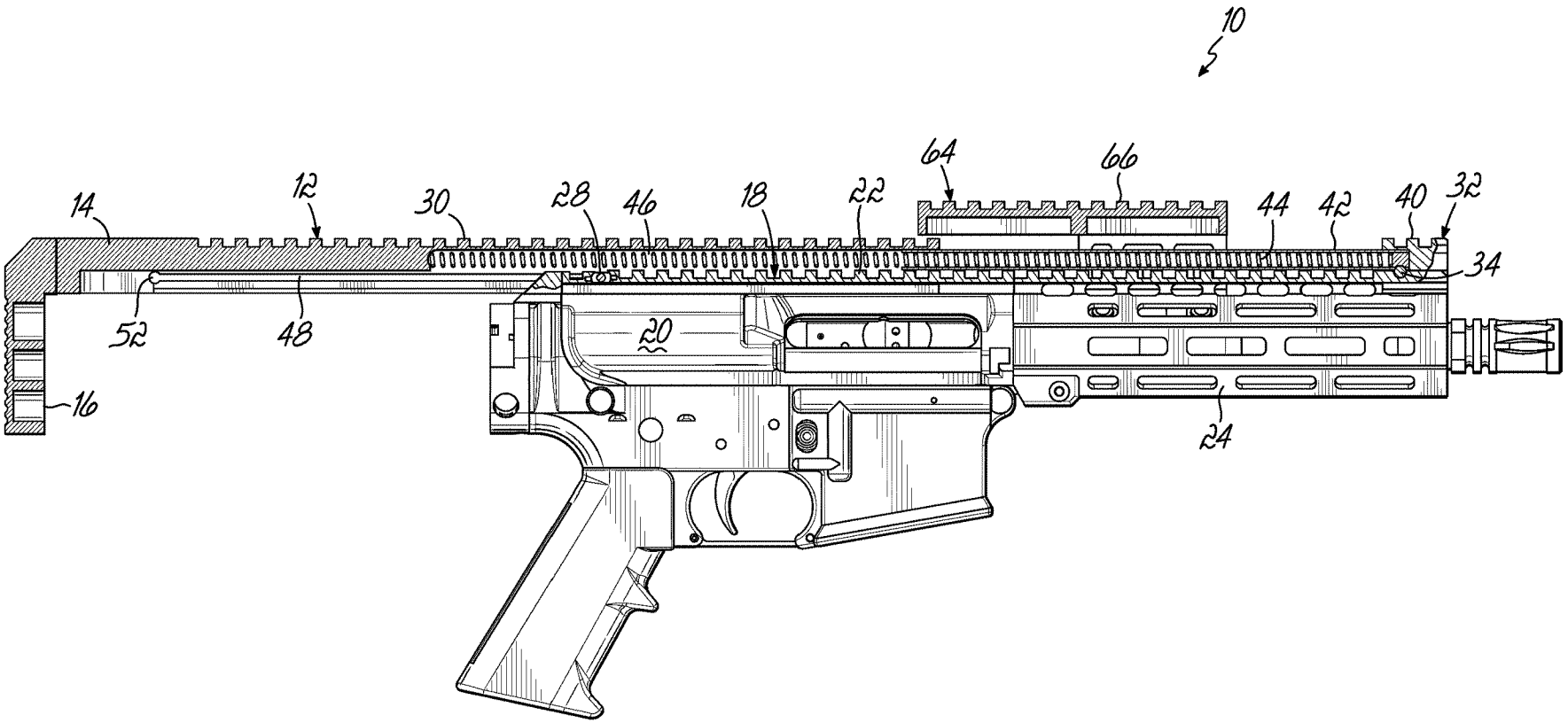
FIG. 4 is a similar view thereof showing the stock in a deployed position.
Figure 5:
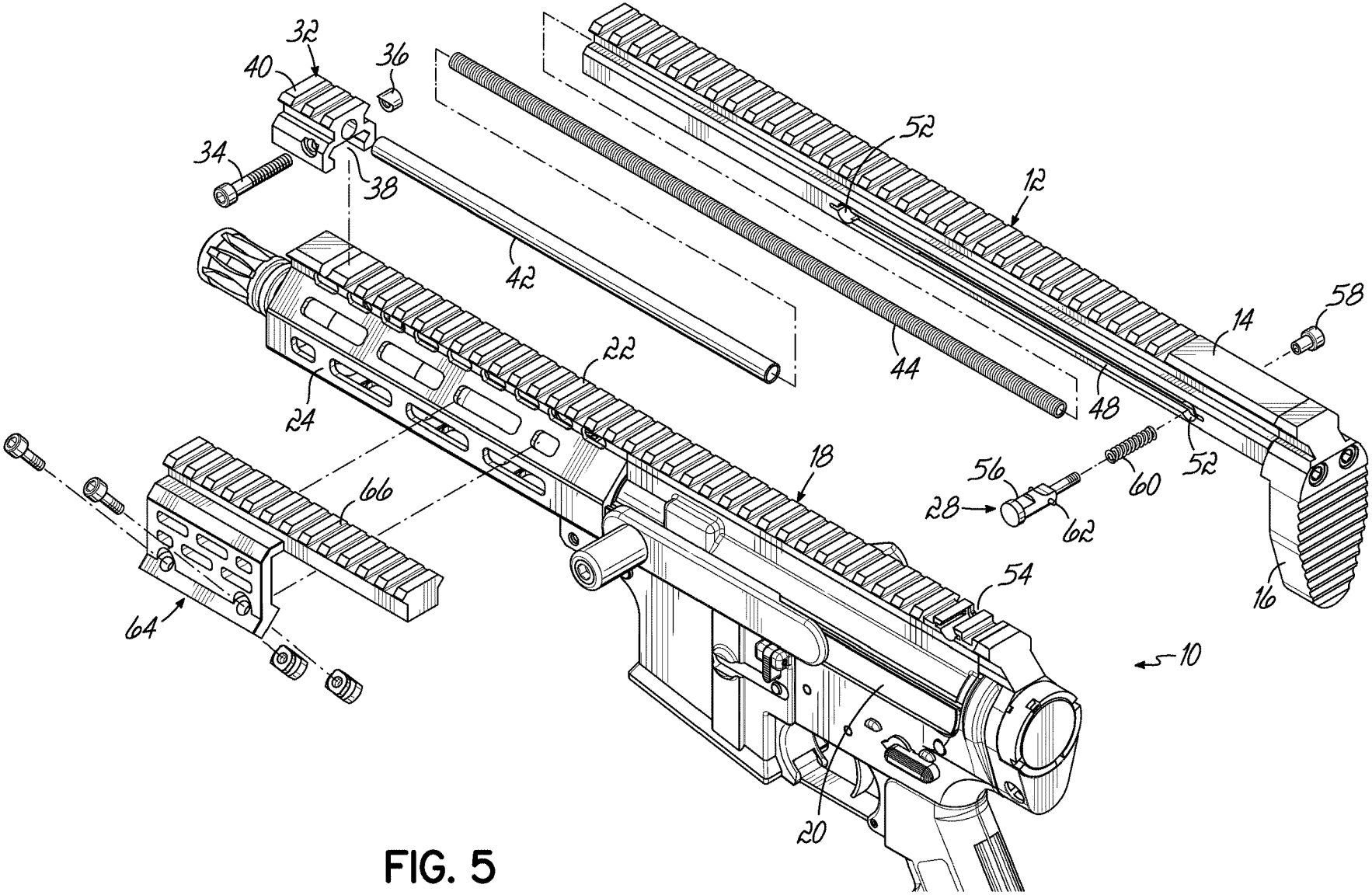
FIG. 5 is an isometric exploded view thereof.
Figure 6:
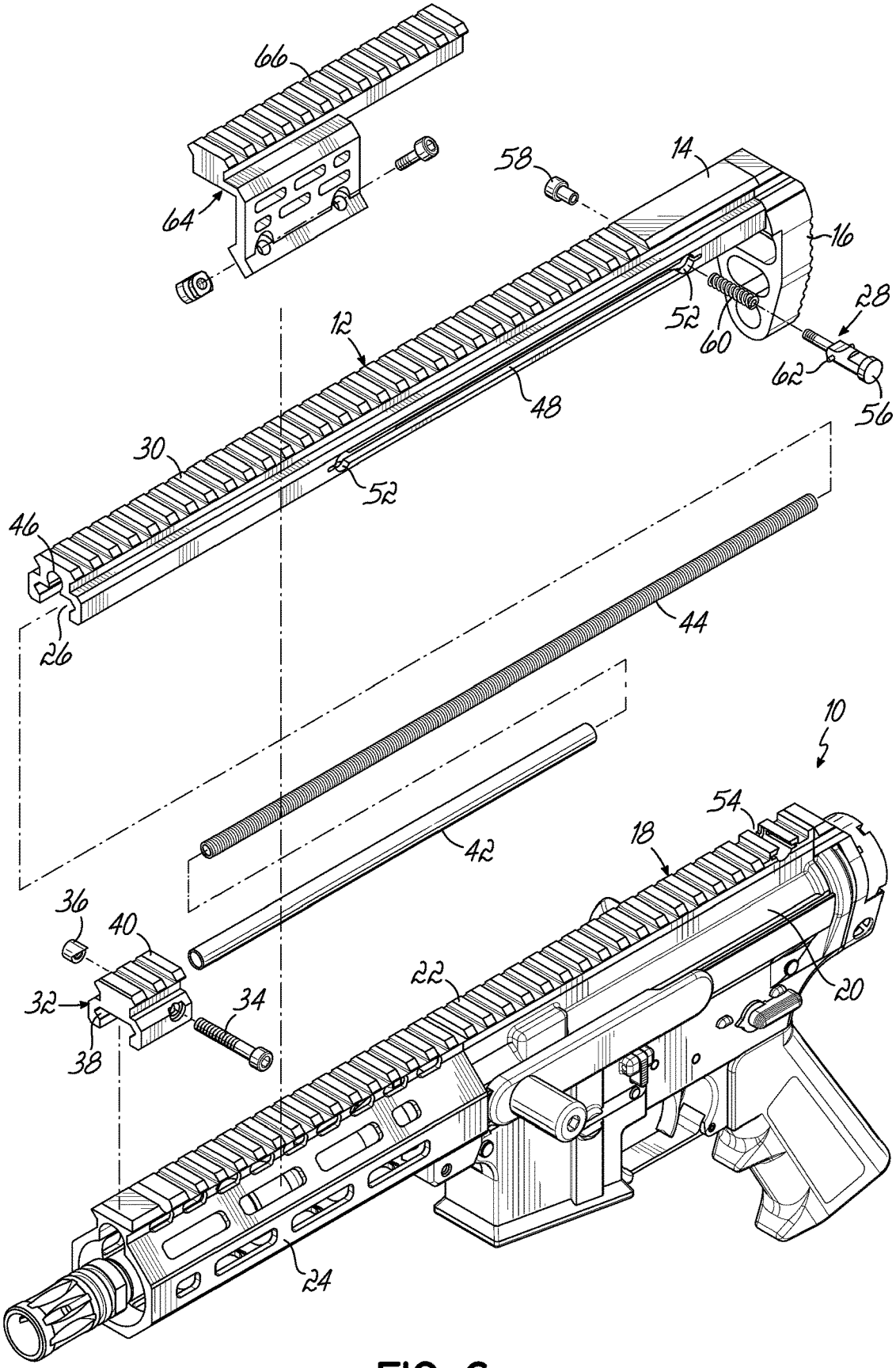
FIG. 6 is an alternate isometric exploded view thereof.

Referring now to FIG. 4, when the latch 28 is released, the deployment spring 44 extends, moving the stock 12 to the rear (see arrows in FIG. 1). The guide tube 42 and guide groove 46 telescope so that the deployment spring remains supported along substantially its entire length. The length of travel is limited by left and right guide slots 48, 50 on opposite sides of the sliding beam 14. One or both of the guide slots 48, 50 may include a socket 52 at either end where the latch 28 locks the stock 12 at either of the fully collapsed or fully deployed positions. If desired, one or more other or additional sockets (not shown) could be provided at intermediate positions so that the stock 12 could be adjusted to more than one length of pull.

Figure 7A:
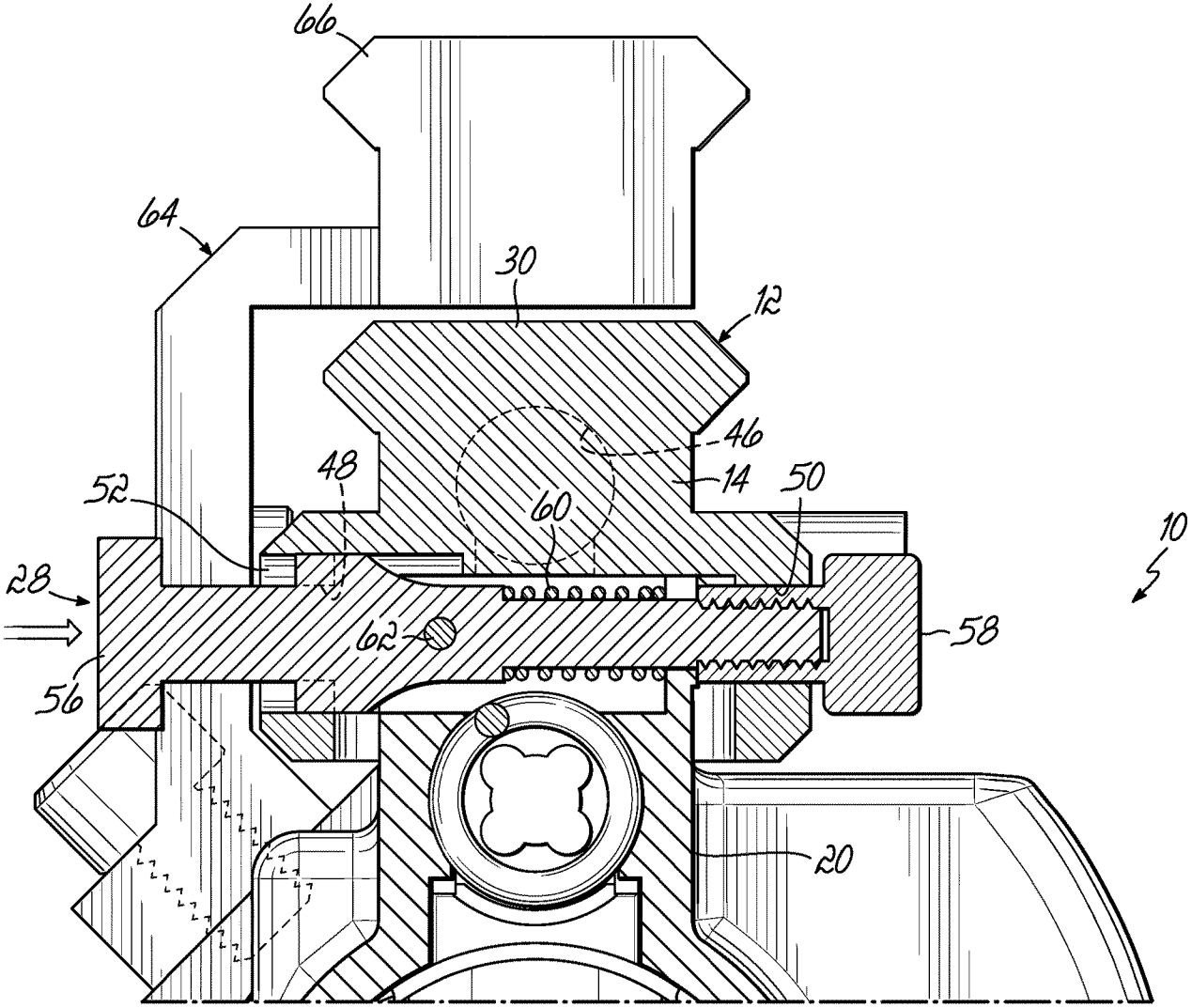
FIG. 7A is a partial cross-sectional view from the rear showing a latch member according to one embodiment of the invention in a locked position.
Figure 7B:
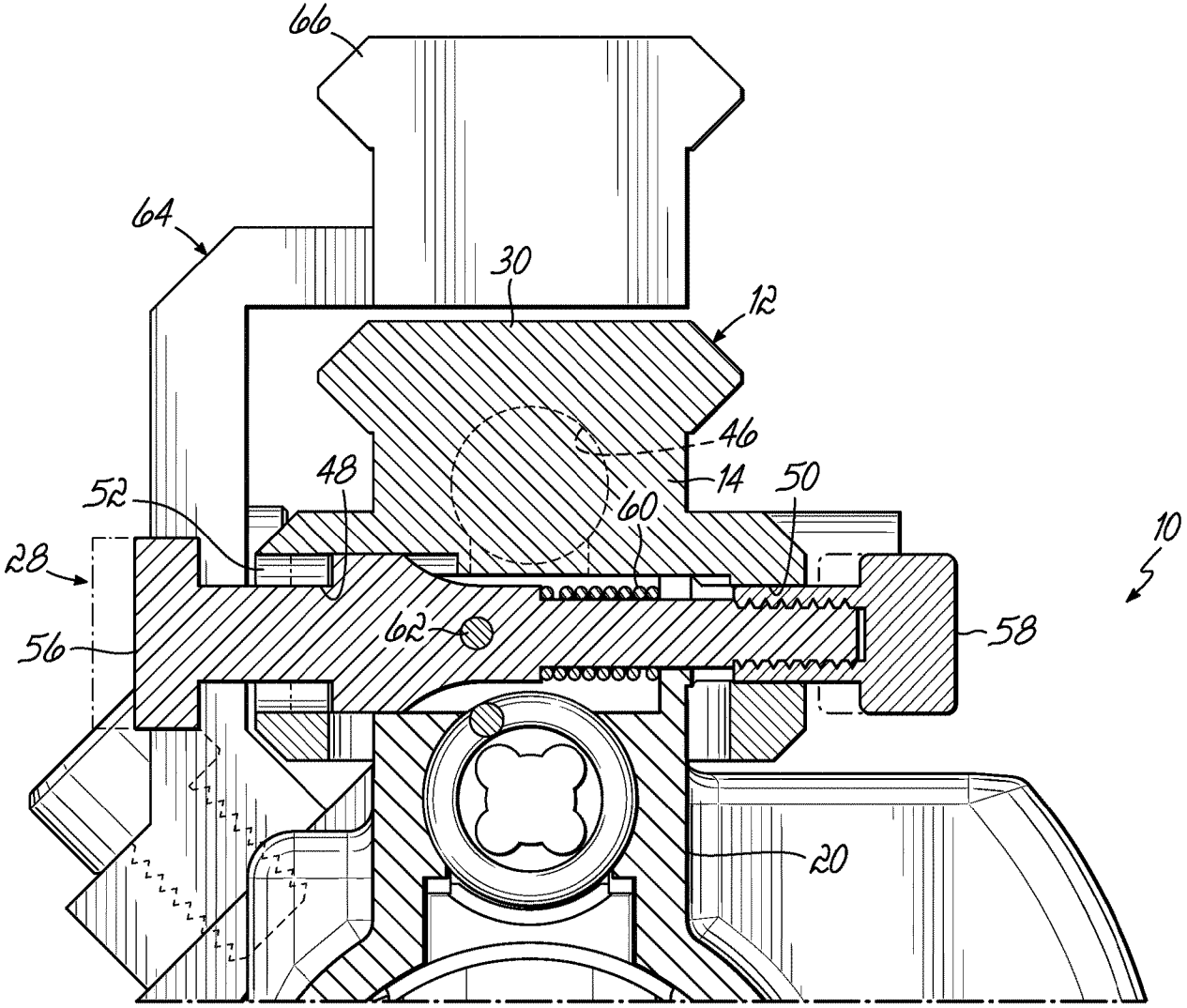
FIG. 7B is a similar view showing the latch member in an unlocked position.

Referring now to FIGS. 5, 6, 7A, and 7B, the top rail 18 of the upper receiver 20 is adapted with a socket 54 to receive and retain the latch 28. The latch 28 is made up of three main parts: a plunger 56, a cap nut 58, and a spring 60. As shown in FIGS. 7A and 7B, the plunger 56 and spring 60 are inserted into the socket 54 and retained captive by the cap nut 58. A button portion of the plunger 56 will extend through the left guide slot 48 and the cap nut 58 will extend through the right guide slot 50 of the sliding beam 14. The plunger 56 may, if desired, also include guide tabs or a cross pin 62 to engage a slot in the socket 54 to prevent rotation of the plunger 56.

When the plunger 56 is pressed (as shown by an arrow in FIG. 7A), an enlarged shoulder engaged in the socket 52 of the sliding beam 14 is moved against the spring 60 to the position shown in FIG. 7B. This allows a narrow portion of the plunger 56 to slide through the left guide slot 48 of the sliding beam 14. When the stock 12 reaches its end of travel, the plunger 56 will be pressed by the spring 60 into engagement with the socket 52 at the opposite end of the left guide slot 48. As previously described, intermittent sockets (not shown) spaced along the left guide slot 48 would allow the stock 12 to be locked at intermittent positions.

According to another embodiment of the invention, an elevated mount 64 providing a fixed accessory rail 66 may be attached to the firearm 10. In the illustrated embodiment, the elevated mount 64 is attached to the forearm 24 using threaded fasteners, such as M-LOK (shown), KEYMOD, or other mounting system. The elevated mount 64 allows an optical sight (not shown) to be mounted at a more appropriate height for alignment with the shooter's eye and at a fixed longitudinal position that does not move with deployment of the stock. The elevated mount 64 may be milled, cast, or extruded from an aluminum alloy or suitable fiber-reinforced polymer material.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A collapsible stock for a firearm having a top surface, comprising:

a sliding beam configured to slidably engage a guide on the top surface and slidable between collapsed and deployed positions;

a butt member on the sliding beam;

an anchor block fixedly attachable to the top surface forward of the sliding beam and a deployment spring, the sliding beam including a guide groove configured to receive the deployment spring, the spring being compressed when the stock is in the collapsed position and extending to deploy the sliding beam to the deployed position, and a latch configured to releasably hold the sliding beam in at least the collapsed and deployed positions.

2. The collapsible stock of claim 1, wherein the anchor block includes an accessory mounting rail.

3. The collapsible stock of claim 1, wherein the sliding beam includes a MIL-STD 1913 accessory mounting rail.

4. The collapsible stock of claim 1, wherein the sliding beam slides on an accessory mounting rail fixed to the firearm top surface.

5. The collapsible stock of claim 4, wherein the accessory mounting rail fixed to the top surface is a MIL-STD-1913 rail.

6. The collapsible stock of claim 4, wherein the latch is fixed to the accessory mounting rail on the firearm top surface.

7. The collapsible stock of claim 1, wherein the anchor block attaches on the accessory mounting rail on the firearm top surface.

8. The collapsible stock of claim 1, further comprising a fixed accessory mount positioned over the collapsed position of the sliding beam.

9. A collapsible stock for a firearm having a top surface, comprising:

a sliding beam slidably attachable to the top surface and slidable between collapsed and deployed positions;

a butt member on the sliding beam;

a latch configured to releasably hold the sliding beam in at least the collapsed and deployed positions;

a forward anchor block fixedly attachable to the top surface and a deployment spring, the sliding beam including a guide groove configured to receive the deployment spring, the spring being compressed when the stock is in the collapsed position and extending to deploy the sliding beam to the deployed position; and a guide tube on the anchor block, wherein the spring is received within the guide tube and the guide tube is received within the guide groove.

10. A firearm, comprising:

a firearm having a top accessory mounting rail;

a collapsible stock, comprising:

a sliding beam having a guide channel shaped to slidingly mate with the top accessory rail and slide between collapsed and deployed positions, and the sliding beam including a MIL-STD 1913 accessory mounting rail;

a butt member on the sliding beam; and a latch fixed to the top accessory mounting rail and configured to releasably hold the sliding beam in at least the collapsed and deployed positions.

* * * * *